US009863346B2

(12) United States Patent
Miao et al.

(10) Patent No.: US 9,863,346 B2
(45) Date of Patent: Jan. 9, 2018

(54) METHOD AND APPARATUS FOR ESTIMATING NITROGEN OXIDES OUT OF AN ENGINE

(71) Applicant: GM Global Technology Operations LLC, Detroit, MI (US)

(72) Inventors: Yong Miao, Ann Arbor, MI (US); Min Sun, Troy, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 433 days.

(21) Appl. No.: 14/505,635

(22) Filed: Oct. 3, 2014

(65) Prior Publication Data

US 2016/0097314 A1 Apr. 7, 2016

(51) Int. Cl.
*F02D 41/00* (2006.01)
*F02D 41/14* (2006.01)
(Continued)

(52) U.S. Cl.
CPC ..... *F02D 41/009* (2013.01); *F02D 35/024* (2013.01); *F02D 35/026* (2013.01);
(Continued)

(58) Field of Classification Search
None
See application file for complete search history.

(56) References Cited

U.S. PATENT DOCUMENTS 3,855,986 A * 12/1974 Wiss ..... F02B 23/00 123/1 R
5,156,002 A * 10/1992 Mowill ..... F23R 3/32 431/174
(Continued)

FOREIGN PATENT DOCUMENTS

| | | | |
|---|---|---|---|
| CN | 1821907 | A | 8/2006 |
| CN | 101641511 | A | 2/2010 |
| CN | 102016267 | A | 4/2011 |

OTHER PUBLICATIONS

Heywood, J., Higgins, J., Watts, P., and Tabaczynski, R., "Development and Use of a Cycle Simulation to Predict SI Engine Efficiency and NOx Emissions," SAE Technical Paper 790291, 1979, doi:10.4271/790291.
(Continued)

*Primary Examiner* — Hung Q Nguyen
*Assistant Examiner* — Brian P Monahon

(57) ABSTRACT

A system is provided and includes a fuel module that, based on a crankshaft angle of an engine, generates a value indicative of an amount of fuel burned in a cylinder or a change in the amount of fuel burned. A heat release module, based on the value, determines an amount of heat released during a combustion event of the cylinder. A pressure module, based on the amount of heat released, estimates a pressure in the cylinder. A temperature module, based on the pressure, estimates a temperature in the cylinder. A concentration module, based on the pressure or the temperature, estimates nitrogen oxide concentration levels in the cylinder. An output module, based on the nitrogen oxide concentration levels, estimates an amount of nitrogen oxides. A control module, based on the amount of nitrogen oxides out of the cylinder, controls operation of the engine or an exhaust system.

18 Claims, 4 Drawing Sheets

(51) Int. Cl.
*F02D 35/02* (2006.01)
*F02D 41/40* (2006.01)
*F02P 5/15* (2006.01)

(52) U.S. Cl.
CPC ..... *F02D 35/028* (2013.01); *F02D 41/1462* (2013.01); *F01N 2430/00* (2013.01); *F02D 41/0007* (2013.01); *F02D 41/0087* (2013.01); *F02D 41/40* (2013.01); *F02P 5/1502* (2013.01)

(56) References Cited

U.S. PATENT DOCUMENTS 6,289,672 B1* 9/2001 Katoh ..... F01N 13/011 60/276
8,161,944 B2 4/2012 Moriya et al.
2001/0025486 A1* 10/2001 Ogiso ..... F01L 9/04 60/285
2004/0255882 A1* 12/2004 Branyon ..... F02B 33/22 123/70 R
2005/0188954 A1* 9/2005 Yoshino ..... F02D 35/025 123/406.29
2005/0197762 A1* 9/2005 Yoshino ..... F02D 35/028 701/111
2007/0100534 A1* 5/2007 Katsumata ..... F02D 35/023 701/103
2008/0010973 A1* 1/2008 Gimbres ..... F02D 35/023 60/276
2009/0031700 A1* 2/2009 Karabeyoglu ..... C06B 47/02 60/205
2010/0071659 A1* 3/2010 Moriya ..... F02D 13/0261 123/406.41
2010/0095933 A1* 4/2010 Moriya ..... F01N 3/0814 123/435
2010/0212295 A1* 8/2010 Narayanaswamy F02D 41/0235 60/285
2011/0036075 A1 2/2011 Hagiwara
2013/0024089 A1* 1/2013 Wang ..... F02D 41/1462 701/102

OTHER PUBLICATIONS

Article: J I Ghojel, Review of the development and applications of the Wiebe function: A tribute to the contribution of Ivan Wiebe to engine research, International Journal of Engine Research, Aug. 1, 2010, vol. 11, No. 4, pp. 297-312, doi:10.1243/14680874JER06510.

* cited by examiner

METHOD AND APPARATUS FOR ESTIMATING NITROGEN OXIDES OUT OF AN ENGINE

FIELD

The present invention relates to engine control systems and exhaust systems, and more particularly to estimating amounts of nitrogen oxides (NOx) out of an engine.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An internal combustion engine (ICE) combusts an air/fuel mixture within cylinders to drive pistons, which produces drive torque. Operation of the ICE, such as spark timing, air intake flow rates, and fuel injection amounts and timing, are controlled based on various monitored parameters. The parameters may include, engine speed, engine temperature, mass air flow, manifold absolute pressure, amounts of NOx out of an engine, etc. Sensors are often used to measure the parameters.

Operation of an ICE may be controlled based on a determination of an amount of NOx output from the ICE. The amount of NOx output may be measured via a NOx sensor. As an alternative, the amount of NOx output may be estimated based on measured pressures within one or more cylinders of the ICE. This however requires one or more pressure sensors in one or more cylinders of the ICE. Although both of these techniques provide fast and accurate estimations of NOx output, both of these techniques require at least one sensor (a NOx sensor or one or more pressure sensors) for the measurement of NOx and/or in-cylinder pressures of the ICE.

SUMMARY

A system is provided and includes a fuel module that, based on a crankshaft angle of an engine, generates a value indicative of (i) an amount of fuel burned in a cylinder of the engine, or (ii) a change in the amount of fuel burned in the cylinder. A heat release module, based on the value, determines an amount of heat released during a combustion event of the cylinder. A pressure module, based on the amount of heat released, estimates a pressure in the cylinder. A temperature module, based on the pressure, estimates a temperature in the cylinder. A concentration module, based on the pressure or the temperature, estimates nitrogen oxide concentration levels in the cylinder. An output module, based on the nitrogen oxide concentration levels, estimates an amount of nitrogen oxides out of the cylinder. A control module, based on the amount of nitrogen oxides out of the cylinder, controls operation of the engine or an exhaust system of the engine.

In other features, a method is provided and includes: based on a crankshaft angle of an engine, generating a value indicative of (i) an amount of fuel burned in a cylinder of the engine, or (ii) a change in the amount of fuel burned in the cylinder; based on the value, determining an amount of heat released during a combustion event of the cylinder; and based on the amount of heat released, estimating a pressure in the cylinder. The method further includes: based on the pressure, estimating a temperature in the cylinder; based on the pressure or the temperature, estimating nitrogen oxide concentration levels in the cylinder; based on the nitrogen oxide concentration levels, estimating an amount of nitrogen oxides out of the cylinder; and based on the amount of nitrogen oxides out of the cylinder, controlling operation of the engine or an exhaust system of the engine.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

As an alternative to determining an amount of NOx output of an engine based on signals from a NOx sensor and/or one or more in-cylinder pressure sensors, an amount of NOx output may be estimated based on a complex model of the engine. Numerous parameters (other than NOx output and in-cylinder pressures) of the engine may be monitored. Combustion and thermodynamic equations may be used to estimate the amount of NOx output. Although this model-based approach does not require a NOx sensor and/or in-cylinder pressure sensors, estimation of an amount of NOx output using this model-based approach is slow and can provide inaccurate results. This approach is slow due to the many monitored parameters and equations needed to be solved to calculate the amount of NOx output.

Examples are disclosed below that include quick and accurate estimations of amounts of NOx output of an engine without the need for a NOx sensor and/or in-cylinder pressure sensors. The examples include a reduced number of parameters and/or equations than the above-stated model-based approach. The examples include mathematical functions with true physical meaning as opposed to using a curve fitting approach.

Also, as used herein, the term combustion cycle refers to the reoccurring stages of an engine combustion process. For example, in a 4-stroke internal combustion engine, a single combustion cycle may refer to and include an intake stroke, a compression stroke, a power stroke and an exhaust stroke. The four-strokes are repeated during operation of the engine.

Figure 1:
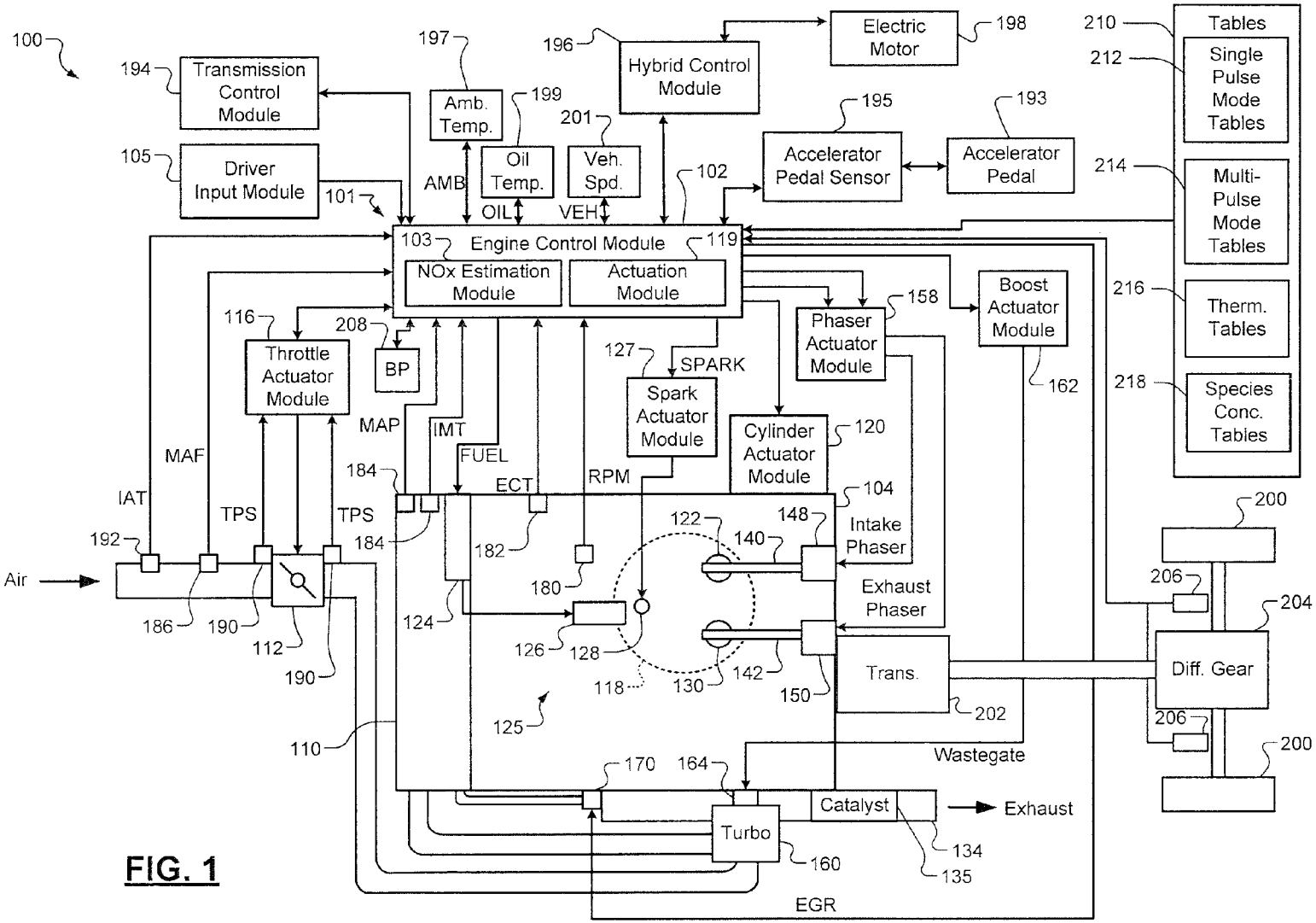
FIG. 1 is a functional block diagram of a powertrain system incorporating a control system including a NOx estimation module in accordance with the present disclosure.

FIG. 1 shows a powertrain system 100 that includes a control system 101. The control system 101 includes an engine control module (ECM) 102 with a NOx estimation module 103. The NOx estimation module 103 estimates an amount of NOx out of an internal combustion engine (ICE) 104. The ICE 104 may be diesel engine, a spark ignition direct injection (SIDI) engine, a homogeneous charge compression ignition (HCCI) engine, a spark ignition engine, stratified spark ignition engine, a spark assisted compression ignition engine or other internal combustion engine. The ECM 102 controls operation of the powertrain system 100 based on the estimated amount of NOx output of the ICE 104.

Although the powertrain system 100 is shown as a hybrid powertrain system, the implementations disclosed herein may be applied to a non-hybrid powertrain system. The powertrain system 100 may be configured for a hybrid electric vehicle and/or a non-hybrid vehicle. The powertrain system 100 includes the ICE 104 that combusts an air/fuel mixture to produce drive torque for a vehicle based on a driver input module 105. Air is drawn into an intake manifold 110 through a throttle valve 112. The ECM 102 commands a throttle actuator module 116 to regulate opening of the throttle valve 112 to control the amount of air drawn into the intake manifold 110. Air from the intake manifold 110 is drawn into cylinder(s) of the ICE 104. The ICE 104 may include any number of cylinders (a single cylinder 118 is shown).

The ECM 102 includes an actuation module 119 that controls a fuel injection system (or fuel actuator module) 124, an ignition system 125, and other modules and devices described below. The ECM 102 controls the amount of fuel injected by a fuel actuator module 124 into the cylinder 118. The fuel actuator module 124 may inject fuel directly into the cylinder 118, as shown, via one or more fuel injectors 126. The ignition system 125 may be included and have one or more spark plugs (or glow plugs) 128.

The powertrain system 100 operates in different fuel injection pulse modes. A first fuel injection pulse mode, referred to as a single pulse mode (SPM), includes the injecting of a single pulse of fuel into a combustion chamber (i.e. the cylinder 118) during a combustion cycle. A combustion cycle may, for example, in a 4-stroke engine, refer to a single sequencing through the 4 strokes (intake, compression, ignition, and exhaust). The SPM includes a single fuel injection pulse per combustion cycle. The single fuel injection pulse may be provided prior to (i.e. during an exhaust stroke) or during an intake stroke. For example, the single fuel injection pulse may be provided within a start-of-injection (SOI) (e.g., at 250°-380° before a piston is at a top most position or top dead center (TDC)). SOI refers to when a fuel injection pulse begins. The timing of the single fuel injection pulse may be referred to as "normal" timing and may be performed at a first predetermined angular position of the crankshaft.

A second fuel injection pulse mode and a third fuel injection pulse mode, referred to as multi-pulse modes (MPMs), include injecting two or more pulses of fuel into the cylinder 118 during a combustion cycle. During a MPM, a first pulse of fuel may be injected into a cylinder during a combustion cycle followed by injection of one or more other pulses of fuel in the same combustion cycle. During the second fuel injection pulse (or dual-pulse) mode, in addition to the first injection, a second injection may be provided early in a compression stroke. As an example, the second fuel injection pulse may be provided with an end-of-injection (EOI) at 140°-220° before TDC. EOI refers to when a fuel injection pulse ends. During the third fuel injection pulse (or triple-pulse) mode, in addition to the first injection and the second injection, a third injection may be provided late in the compression stroke. For example, the third injection pulse may be provided with an EOI at 0°-140° before TDC. As another example, a diesel engine may operate is the MPM mode and inject two pulses of fuel in each cylinder of the diesel engine per combustion cycle.

During the MPMs, the first fuel injection pulse of fuel into the cylinder 118 may provide 20-90% of a total fuel charge for a single combustion (or engine) cycle. The second pulse or the second and third pulses of fuel may each provide 10-80% of the total fuel charge for a single combustion cycle. As an example, during the dual-pulse mode, a first pulse of fuel may provide 60% of a total fuel charge for a combustion cycle and be generated prior to or during an intake stroke. The second pulse of fuel may provide 40% of the total fuel charge and may be injected during the compression stroke.

As another example, during the triple-pulse mode, the first pulse of fuel may provide 60% of a total fuel charge for a combustion cycle and be generated prior to or during an intake stroke. The second pulse of fuel and the third pulse of fuel may each provide 20% of a total fuel charge. The same overall amount of fuel provided to the cylinder and/or the same overall air/fuel ratio within the cylinder may be provided during one or more combustion cycle(s) regardless of whether the powertrain system 100 is operating in the SPM or one of the MPMs.

Although the SPM and the MPMs may each provide lean, stoichiometric and/or rich overall air/fuel ratios in each of the cylinder(s) 118, during the MPMs the second and third fuel injection pulses provide a rich and/or richer air/fuel ratio (less than 14.7:1 air/fuel ratio) near the spark plug(s) 128 in the cylinder(s) 118. The second and third fuel injection pulses of fuel increase in-cylinder motion of air/fuel particles in the cylinder(s) 118 and provide a small rich cloud(s) around the spark plug(s) 128, which increases combustion stability. This rich air/fuel mixture near the spark plug(s) 128 may provide strong ignitions resulting in a more complete combustion.

In operation, air from the intake manifold 110 is drawn into the cylinder 118 through an intake valve 122. The fuel injected by the fuel actuator module 124 mixes with the air and creates the air/fuel mixture in the cylinder 118. A piston (not shown) within the cylinder 118 compresses the air/fuel mixture. Based upon a signal from the ECM 114, a spark actuator module 127 may energize the spark plug 128 in the cylinder 118, which ignites the air/fuel mixture. Ignition timing may be referred to as spark timing herein. Fuel injection and spark timing may be specified relative to an angular position of the crankshaft of the ICE 104 and relative to when the piston is at TDC. At TDC the air/fuel mixture is in a most compressed state.

The combustion of the air/fuel mixture drives the piston down, thereby rotating the crankshaft. The piston then begins moving up again and expels the byproducts of combustion including NOx through an exhaust valve 130. At least some of the byproducts of combustion are exhausted from the vehicle via an exhaust system 134. Exhaust passes through a catalyst 135.

The intake valve 122 may be controlled by an intake camshaft 140, while the exhaust valve 130 may be controlled by an exhaust camshaft 142. An ECM 102 may regulate the position of the intake valve 122 and/or the exhaust valve 130 to regulate the quantity of air ingested and inert residual gases retained in the cylinder 118. The ECM 102 may also adjust operation of the fuel injector(s) 126, such as ON time and/or size of injector openings, to increase the amount of fuel injected into the cylinder 118. The ECM 102 may also adjust the timing of the exhaust camshaft(s) corresponding to the change in the air/fuel mixture.

The crankshaft angle at which the intake valve 122 is opened may be varied with respect to piston TDC by an intake cam phaser 148. The crankshaft angle at which the exhaust valve 130 is opened may be varied with respect to piston TDC by an exhaust cam phaser 150. A phaser actuator module 158 controls the intake cam phaser 148 and the exhaust cam phaser 150 based on signals from the ECM 102.

The powertrain system 100 may include a boost device that provides pressurized air to the intake manifold 110. For example, FIG. 1 depicts a turbocharger 160. The turbocharger 160 is powered by exhaust gases flowing through the exhaust system 134, and provides a compressed air charge to the intake manifold 110. The turbocharger 160 may compress air before the air reaches the intake manifold 110.

A wastegate 164 may allow exhaust gas to bypass the turbocharger 160, thereby reducing the turbocharger's output (or boost). The ECM 102 controls the turbocharger 160 via a boost actuator module 162. The boost actuator module 162 may modulate the boost of the turbocharger 160 by controlling the position of the wastegate 164. The compressed air charge is provided to the intake manifold 110 by the turbocharger 160. An intercooler (not shown) may dissipate some of the compressed air charge's heat, which is generated when air is compressed and may also be increased by proximity to the exhaust system 134. As an alternative and/or in addition to incorporating the turbocharger 160 in the powertrain system 100, the powertrain system 100 may include a supercharger (not shown). The supercharger may provide compressed air to the intake manifold 110 and may be driven by the crankshaft.

The powertrain system 100 may include an exhaust gas recirculation (EGR) valve 170, which selectively redirects exhaust gas back to the intake manifold 110. In various implementations, the EGR valve 170 may be located after the turbocharger 160. The powertrain system 100 may measure the speed of the crankshaft in revolutions per minute (RPM) using an engine speed sensor 180. The temperature of the engine coolant may be measured using an engine coolant temperature (ECT) sensor 182. The ECT sensor 182 may be located within the ICE 104 or at other locations where the coolant is circulated, such as a radiator (not shown).

The pressure within the intake manifold 110 may be measured using a manifold absolute pressure (MAP) sensor 184. In various implementations, engine vacuum may be measured, where engine vacuum is the difference between ambient air pressure and the pressure within the intake manifold 110. The mass of air flowing into the intake manifold 110 may be measured using a mass air flow (MAF) sensor 186. The MAF sensor 186 may be located in a housing that includes the throttle valve 112.

The throttle actuator module 116 may monitor the position of the throttle valve 112 using one or more throttle position sensors (TPS) 190. The ambient temperature of air being drawn into the powertrain system 100 may be measured using an intake air temperature (IAT) sensor 192.

The ECM 102 and/or the NOx estimation module may use signals from the sensors 180, 182, 186, 190, 192 and from other sensors disclosed herein to estimate an amount of NOx output and make control decisions for the powertrain system 100. The actuation module 119 may use signals from the sensors 180, 182, 186, 190, 192 and from other sensors disclosed herein to determine whether to transition in and out of the SPM and the MPMs.

The ECM 102 may communicate with a transmission control module 194 to coordinate shifting gears in a transmission (not shown). For example, the ECM 102 may reduce torque during a gear shift. The ECM 102 may communicate with a hybrid control module 196 to coordinate operation of the ICE 104 and an electric motor 198. The electric motor 198 may also function as a generator, and may be used to produce electrical energy for use by vehicle electrical systems and/or for storage in a battery. In various implementations, the ICE 104, the transmission control module 194, and the hybrid control module 196 may be integrated into one or more modules.

To abstractly refer to the various control mechanisms of the ICE 104, each system that varies an engine parameter may be referred to as an actuator. For example, the throttle actuator module 116 can change the blade position, and therefore the opening area, of the throttle valve 112. The throttle actuator module 116 can therefore be referred to as an actuator, and the throttle opening area can be referred to as an actuator position.

Similarly, the spark actuator module 126 can be referred to as an actuator, while the corresponding actuator position is an amount of spark advance. Other actuators include the boost actuator module 162, the EGR valve 170, the phaser actuator module 158, the fuel actuator module 124, and the cylinder actuator module 120. The term actuator position with respect to these actuators may correspond to boost pressure, EGR valve opening, intake and exhaust cam phase angles, air/fuel ratio, and number of cylinders activated, respectively.

While electric motor 198 may provide torque in series and/or in parallel with the torque output of ICE 104, it should be appreciated that other configurations are also contemplated to be within the scope of this description. For example, electric motor 198 may be implemented as one or more electric motors that provide torque directly to wheels 200 instead of passing through a transmission 202.

The combined torque of ICE 104 and electric motor 198 is applied to an input of transmission 202. Transmission 202 may be an automatic transmission that switches gears in accordance with a gear change command from the ECM 102. An output shaft of transmission 202 is coupled to an input of a differential gear 204. Differential gear 204 drives axles and wheels 200. Wheel speed sensors 206 generate signals that indicate a rotation speed of their respective wheels 200.

The ECM 102 estimates an engine output torque to provide based on received sensor signals and other parameters described herein. The ECM 102 may adjust position of the throttle, air-fuel ratio, valve timing, fuel injection, etc. to provide the estimated engine output torque. Based on a target engine output torque, the ECM 102 controls engine devices such that a desired air flow, a desired fuel injection, and/or a desired spark timing is achieved. The target engine output torque may be based on a vehicle operator (driver) request and/or may be controller based, such as a torque output request from a cruise control system.

The sensor signals that are received by the ECM 102 may include sensor signals from: the MAP sensor 184, the MAF sensor 186, the throttle position sensor 190, the IAT sensor 192, an accelerator pedal position sensor 195, or other sensors, such as the engine coolant temperature sensor 182, the engine speed sensor 180, an ambient temperature sensor 197, an oil temperature sensor 198, and a vehicle speed sensor 201.

The ECM 102 communicates with the throttle actuator module 116. The ECM 102 receives a throttle position signal from the throttle position sensor 190 and adjusts throttle position based on the throttle position signal. The ECM 102 may control the throttle 112 using a throttle actuator based on a position of an accelerator pedal 193. The throttle actuator module 116 may include a motor or a stepper motor, which provides limited and/or coarse control of the throttle position.

The ECM 102 may determine a throttle area based on a target MAP and a target MAF, and may generate a control signal to control the throttle based on the throttle area. The target MAP and MAF may be determined based on engine speed and torque request signals.

The powertrain system 100 may further include a barometric pressure sensor 208. The barometric pressure sensor 208 may be used to determine environmental conditions, which may be further used to determine a desired throttle area. The desired throttle area may correspond to a specific throttle position.

The powertrain system 100 may also include various tables 210, which may be used by the actuation module 119, the NOx estimation module 103 and/or other modules of the powertrain system 100. The tables 210 may include SPM tables 212, MPM tables 214, thermodynamic tables 216, and species concentration tables 218. The tables 210 may each be associated with one or more of the tasks described with respect to the method of FIG. 3. The NOx estimation module 103 may estimate an amount of NOx out of each of the cylinders 118 of the ICE 104 and/or a total amount of NOx out of the ICE 104 based on any and/or all of the sensor signals disclosed herein. Example modules of the NOx estimation module 103 are shown and described with respect to FIGS. 2 and 3.

Figure 2:
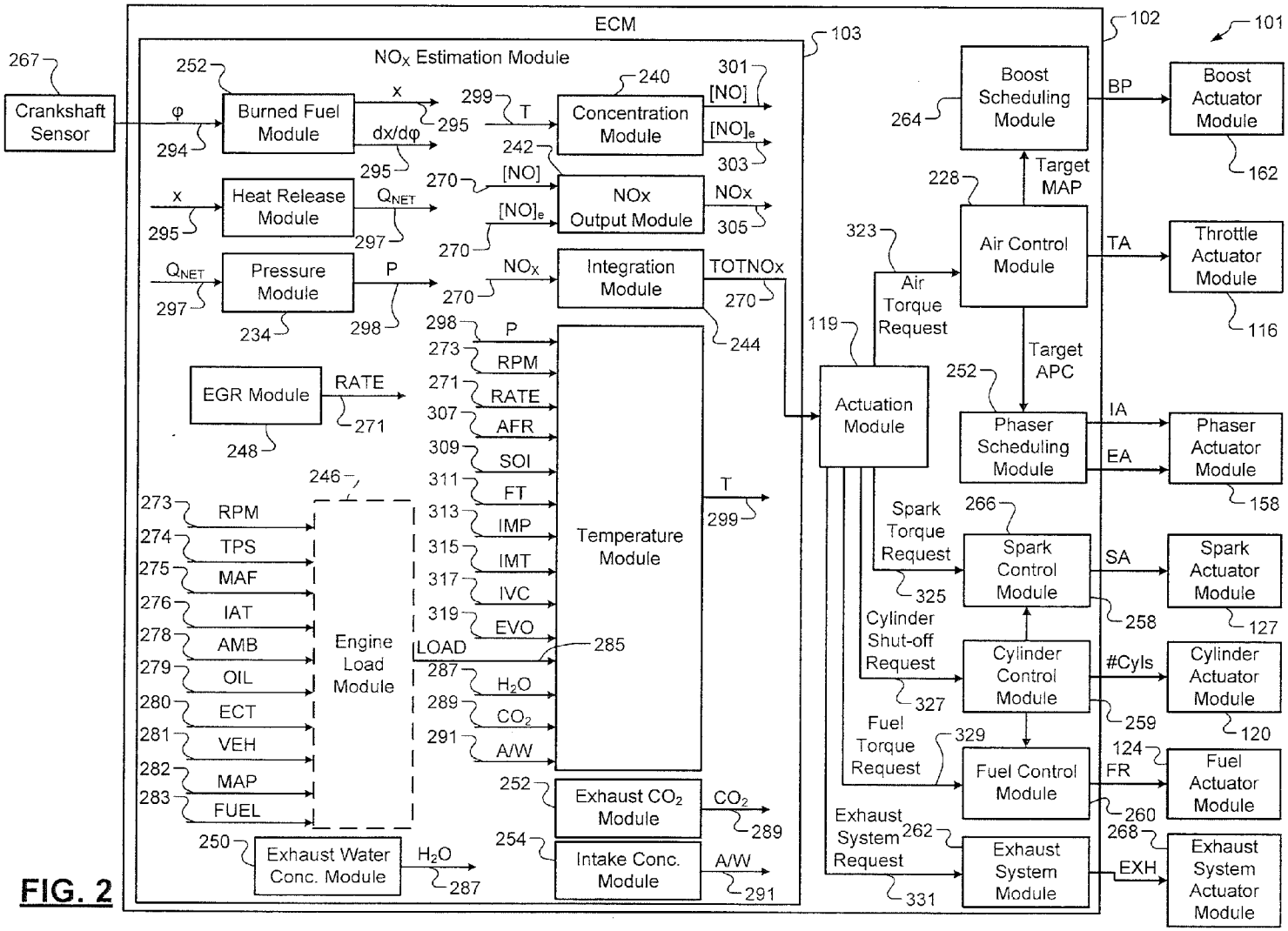
FIG. 2 is a functional block diagram of the control system including the NOx estimation module in accordance with the present disclosure.

Referring now also to FIG. 2, which shows the control system 101 including the ECM 102 and the NOx estimation module 103. The NOx estimation module 103 includes a burned fuel module 230, a heat release module 232, a pressure module 234, a temperature module 238, a concentration module 240, a NOx output module 242, and an integration module 244. The NOx estimation module 103 and/or the ECM 102 may also include an engine load module 246, an EGR module 248, an exhaust water concentration module 250 an exhaust carbon dioxide ($CO_2$) module 252, and an intake concentration module 254. In one embodiment, the modules 102, 103 do not include the modules 246, 248, 250, 252, 254.

The ECM 102 includes the NOx estimation module 103, the actuation module 119, an air control module 256, a spark control module 258, a cylinder control module 259, a fuel control module 260, an exhaust system module 262, a boost scheduling module 264, and a phase scheduling module 266. The exhaust system module 262 is connected to and controls an exhaust system actuator module 268 based on an output of the integration module 244. The exhaust system actuator module 268 may actuate one or more valves of the exhaust system 134. The exhaust system actuator module 268 may also control regeneration of the exhaust system 134, which may include controlling electrical heating of one or more coils (or electrical elements) in the exhaust system 134. The exhaust system actuator module 268 may control urea injection into the exhaust system 134. The modules 256, 258, 259, 260, 262, 264 and 266 control respectively the actuator modules 116, 127, 120, 124, 268, 162, 158. The modules 256, 258, 259, 260, 262, 264 and 266 may generate a target area signal TA, a spark advance signal SA, a cylinder deactivation signal #Cyls, a fuel rate signal FR, an exhaust signal EXH, a boost pressure signal BP, an intake angle signal IA, and an exhaust angle signal EA, which may be provided to and used to control the modules 116, 127, 120, 124, 268, 162, 158.

Figure 3:
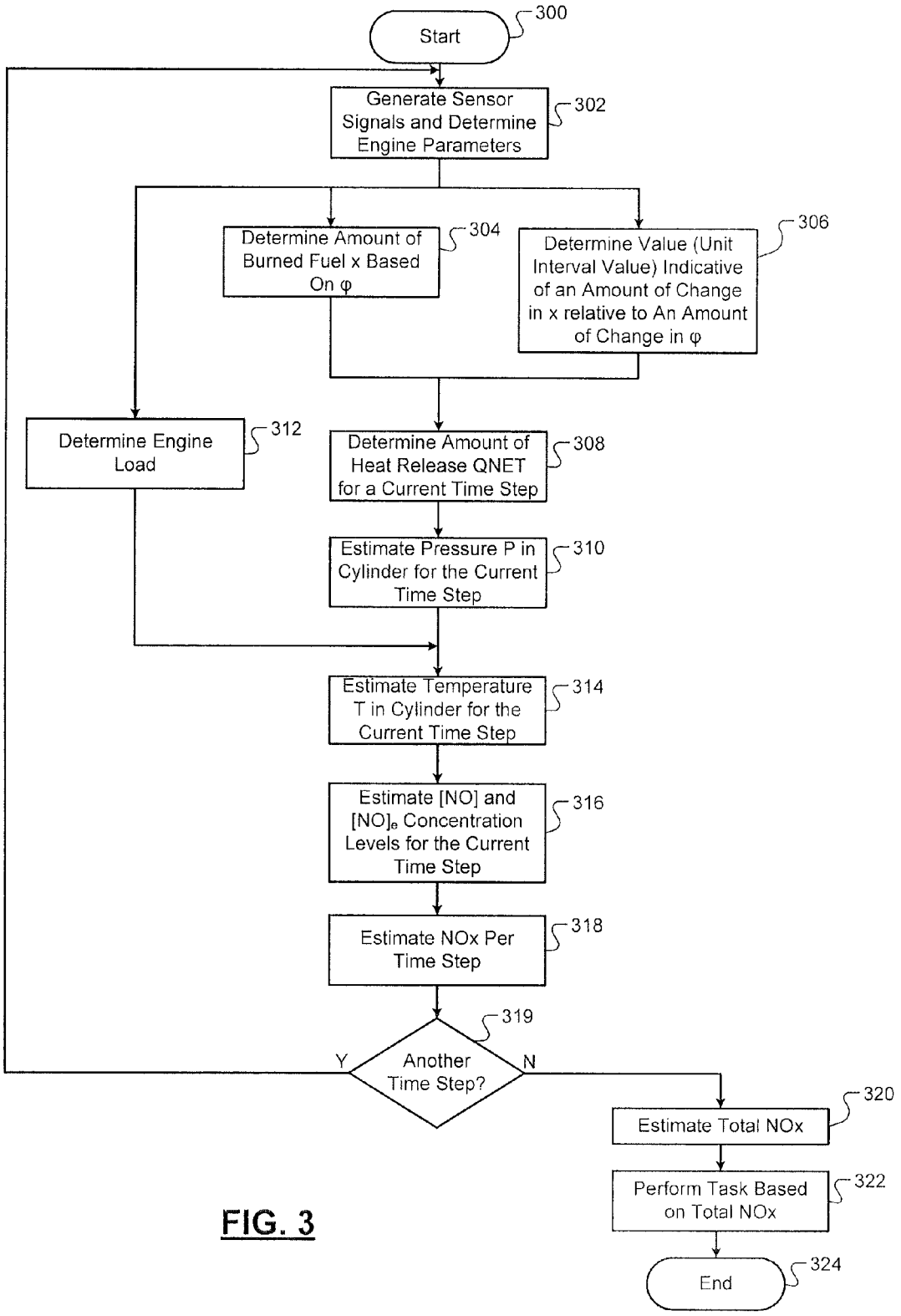
FIG. 3. illustrates a NOx estimation method in accordance with the present disclosure.

The powertrain system 100 and the NOx estimation system 101 may be operated using numerous methods. An example NOx estimation method is illustrated in FIG. 3. Although the following tasks are primarily described with respect to the implementations of FIGS. 1-2, the tasks may be easily modified to apply to other implementations of the present disclosure. The tasks may be iteratively performed.

The method may begin at 300. At 302, the parameter sensor signals described above are generated and other engine parameters are determined. This may include generating the sensor signals RPM, TPS, MAF, IMT, IAT, AMB, OIL, ECT, VEH, MAP, and FUEL. The EGR module 248 determines an EGR rate (e.g., a certain percentage of a total exhaust flow rate) RATE 271. The EGR rate is provided by signal 271. The fuel control module 260 may determine: an air/fuel ratio (an amount of air in kilo-grams (kgs) divided by an amount of fuel in kgs); fuel injection start times of the cylinders 118, which may be indicated based on a respective crankshaft angle φ of the engine; and a total injected amount of fuel for each engine cycle (kg per cycle per cylinder). The crankshaft angle φ may be indicated via a crankshaft sensor 267. The ECM 102 may determine and/or access from memory: intake valve close times for intake valves of the ICE 104; exhaust valve close times for exhaust valves of the ICE 104; volumes of the cylinders 118; diameters of pistons in the cylinders 118; and/or other parameters.

The engine load module 246 may determine load on or output torque of the ICE 104 based on the parameter sensor signals and generates the engine load signal LOAD (signal 285). In one embodiment, the engine load module 246 is not included and/or output of the engine load module is not used for NOx estimation. The engine load may alternatively be determined at 312, as described below. The engine load module 246 may determine engine load based on various parameters. The parameters may be determined based on parameter sensor signals from the above-described sensors of FIG. 1. For example, the engine load module 246 may determine engine load based on an engine speed signal RPM (273), a throttle position signal TPS (274), a mass air flow signal MAF (275), an intake air temperature signal IAT (276), an ambient temperature signal AMB (278), an oil temperature signal OIL (279), an engine coolant temperature ECT (280), a vehicle speed signal VEH (281), a manifold absolute pressure signal MAP (282), and/or other sensor signals and/or signals from modules of the ECM 102. An example, of a signal from one of the modules of the ECM 102 is a fuel injection control signal FUEL (283), which may be provided by the fuel control module 260 and/or the fuel actuator module 124. The engine load module 246 generates an engine load signal LOAD (285) indicating the engine load based on the sensor signals.

The exhaust water concentration module 250 may estimate an amount of water concentration $H_20$ (signal 287) in an exhaust of the ICE 104. The exhaust $CO_2$ module may estimate an amount of $CO_2$ (signal 289) in the exhaust of the ICE 104. This may be based on the above-stated parameters and/or a $CO_2$ signal from a $CO_2$ sensor of the exhaust system 134. The intake concentration module 254 may estimate amounts of air and water A/W (signal 291) in an intake manifold 110 of the ICE 104.

At 304, the burned fuel module 230 may determine a total amount of burned fuel x (signal 294) at each crankshaft angle (p (signal 295) for each cylinder of the ICE 104 and/or collectively as a total for all of the cylinders 118. As an example, the total amount of burned fuel x may be determined using one or more mathematical functions, such as one or more Wiebe functions. For example, the total amount of burned fuel x may be represented by equation 1, where $\varphi$ is the crankshaft angle, $e^{m(\varphi/\varphi_1)^2}$ is the inverse natural logarithm of $m(\varphi/\varphi_1)^2$, where m, $\varphi_1$ and $\varphi_2$ are calibrated predetermined values and $x_{1max}$ and $x_{2max}$ are amounts of fuel (or fuel mass values) for each fuel injection of a dual-pulse cycle. Equation 1 is an example of a Wiebe function shown in an integration form. As an example, m may be equal to −0.5. The burned fuel module 230 may determine the values m, $\varphi_1$ and $\varphi_2$ based on: a particular type, size, style, number of cylinders, etc. of the ICE 104; an operating condition of the engine; and/or one or more of the sensor signals and/or parameters disclosed herein and determined by one or more of the modules of the ECM 102. The values m, $\varphi_1$ and $\varphi_2$ may vary and/or may be looked-up in one or more of the tables 210 based on the sensor signals, operating conditions, and/or parameters of the one or more of the modules of the ECM 102.

$$x=x_{1max}[1-e^{m(\varphi/\varphi_1)^2}]+x_{2max}[1-e^{m(\varphi/\varphi_2)^2}] \quad [1]$$

Figure 4:
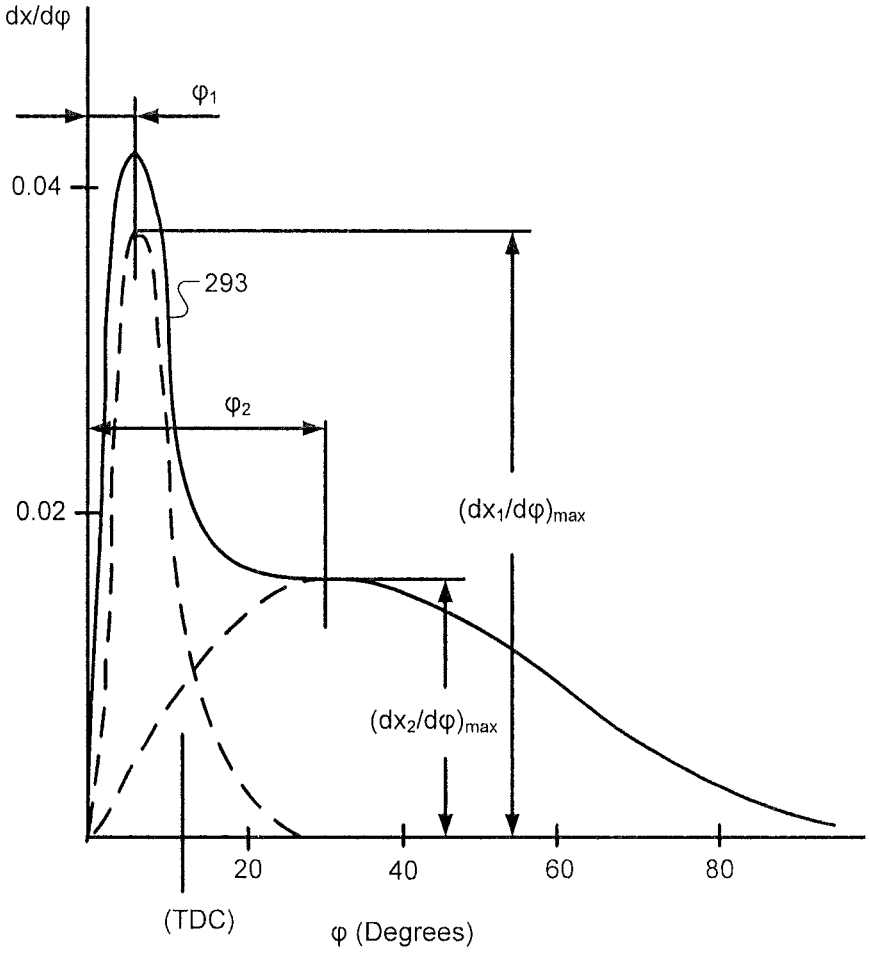
FIG. 4 is a plot illustrating changes in an amount of burned fuel (mass of burned fuel) relative to changes in crankshaft angle.

A plot of a derivative of equation 1 (or $$\left(\text{or } \frac{dx}{d\varphi}\right)$$

is shown as a curve 293 in FIG. 4. Equation 1 is in an integration form representing an area under the curve 293. The plot is of differential values of the total amount of burned fuel x relative to crankshaft angle. In other words, changes in the total amount of burned fuel x relative to change in the crankshaft angle $\varphi$ is shown. The curve 293 has two peaks and may be used for a diesel engine operating in a MPM, where each engine cycle of a cylinder has a pilot fuel injection pulse and a main fuel injection pulse.

As an alternative to task 304 or in addition to task 304, task 306 may be performed to calculate the amount of burned fuel x. At 306, the derivative $$\frac{dx}{d\varphi}$$

(signal 296) is determined. As an example, the derivative $$\frac{dx}{d\varphi}$$

may be represented by equation 2.

$$\frac{dx}{d\varphi}=\frac{x_{1max}}{\varphi_1}\left(\frac{\varphi}{\varphi_1}\right)e^{m(\varphi/\varphi_1)^2}+\frac{x_{2max}}{\varphi_2}\left(\frac{\varphi}{\varphi_2}\right)e^{m(\varphi/\varphi_2)^2} \quad [2]$$

Equation 2 is an example of the Wiebe function of equation 1 shown in a derivative (or differential) form. The derivative $$\frac{dx}{d\varphi}$$

provides a unit interval value greater than or equal to 0 and less than or equal to 1. The derivative $$\frac{dx}{d\varphi}$$

is typically greater than 0.

At 308, the heat release module 232 determines, based on the amount of burned fuel x and/or the unit interval value, the amount of heat released $Q_{NET}$ (signal 297) for a current time step and the cylinders 118. The current time step may be a predetermined amount of time and may be based on a clock signal having a predetermined frequency. The amount of heat released $Q_{NET}$ may be set equal to the amount of burned fuel x multiplied by a fuel heat value. The fuel heat value is a predetermined constant value.

If task 304 is performed, the amount of heat released $Q_{NET}$ may be estimated based on a difference between a current crankshaft angle $\varphi_c$ and a previous crankshaft angle $\varphi_{c-1}$. The amount of heat released for the current time step may be set equal to an amount of heat released as determined for the current crankshaft angle $\varphi_c$ minus an amount of heat released and/or determined for the previous crankshaft angle $\varphi_{c-1}$. If task 306 is performed, the total amount of burned fuel up until the previous crankshaft angle $\varphi_{c-1}$ plus the difference in the amounts of burned fuel for the current crankshaft angle $\varphi_c$ and the previous crankshaft angle $\varphi_{c-1}$ may provide the updated total amount of fuel burned. The updated total amount of fuel burned may then be used to estimate the amount of heat released up until the current crankshaft angle $\varphi_c$ (or the total amount of heat released).

At 310, the pressure module 234 estimates an amount of in-cylinder pressure P (signal 298) based on the heat released $Q_{NET}$ for the current time step in each of the cylinders 118. The amount of in-cylinder pressure may be determined for each of the cylinders 118. The in-cylinder pressures may be determined based on, for example, equation 3.

$$V\frac{dP}{d\varphi}=\frac{\gamma-1}{\gamma}\cdot\frac{dQ_{NET}}{d\varphi}+P\frac{dV}{d\varphi} \quad [3]$$

At 312, the engine load module 246 may determine the load on the ICE 104 based on one or more of the sensor signals and/or parameters disclosed herein and determined by one or more of the modules of the ECM 102. Task 312 may be performed during one or more of tasks 304-310.

At 314, the concentration module 240 estimates a temperature T (signal 299) in each of the cylinders 118 for the current time step based on: the in-cylinder pressures P for each of the cylinders 118; and one or more of the sensor signals and/or parameters disclosed herein and determined by one or more of the modules of the ECM 102. The temperatures T may be determined based on the ideal gas law (PV=nrT), where P is an in-cylinder pressure, V is a volume within a corresponding cylinder, n is an amount of substance (air/fuel mixture) in the cylinder, r is the ideal or universal gas constant, and T is the temperature in the cylinder. The volume V depends on piston displacement.

In one embodiment, each of the temperatures T of each of the cylinders 118 is determined based on: the corresponding volume V; a corresponding piston diameter; the engine speed RPM; the exhaust gas recirculation rate RATE (or percent of total exhaust flow rate); an air/fuel ratio AFR (an amount of air in kilograms to an amount of fuel in kilograms) (signal 307); a start time of fuel injection SOI (signal 309); a total amount of injected fuel FT (in kilograms per cycle per cylinder) (signal 311); an intake manifold pressure IMP (in kilo-Pascals) (signal 313); an intake manifold temperature (in degrees Kelvin) (signal (315); an intake valve close time IVC (in crankshaft angle degrees) (signal 317); and an exhaust valve open time EVO (in crankshaft angle degrees) (signal 319). The temperatures T may be determined based on one or more of the signals 287, 289, 291. The temperatures T may be determined based on predetermined tables relating these parameters to, for example, the estimated pressures for the ICE 104.

At 316, the concentration module 240 estimates, for each of the cylinders 118, species concentration amounts (or levels) for a reaction gas in a non-equilibrium state and the reaction gas in an equilibrium state for the current time step. For example, a concentration level of nitrogen oxide (identified as [NO]) in a non-equilibrium state and a concentration level of nitrogen oxide in an equilibrium state (identified as $[NO]_e$) is determined. The species concentrations levels [NO] and $[NO]_e$ are indicated by signals 301, 303. The species concentrations may be determined based on the pressures P determined at 310, the temperatures T determined at 314, one or more of the tables 216, 218, and/or thermodynamic equations defining conditions and/or states of the ICE 104. The tables 218 may relate the pressures P and/or the temperatures T to species concentration levels (e.g., [NO], $[NO]_e$). The concentration levels may be determined based on one or more of the signals 271, 287, 289, 291, 298, 307, 309, 311, 313, 315, 317, 319.

At 318, the NOx output module 242 estimates an amount of NOx out of the ICE 104 (signal 305) based on the species concentration levels [NO], $[NO]_e$. This may be determined via equation 4, where $R_1$, $R_2$, $R_3$ are reaction rates that may be derived from Zeldovich kinetic equations.

$$\frac{d[NO]}{dt} = \frac{2R_1\left\{1-\left(\frac{[NO]}{[NO]_e}\right)^2\right\}}{1+\left(\frac{[NO]}{[NO]_e}\right)\left(\frac{R_1}{R_2+R_3}\right)} \quad [4]$$

The amounts of NOx for each time step (or determined for each time that task 318 is performed) may be stored in a memory of the ECM 102 and later accessed at task 320.

At 319, the NOx estimation module 103 determines whether to perform one or more of tasks 302-318 again for another (or next) time step. If one or more of tasks 302-318 is repeated, the next time step becomes the current time step. If one or more of tasks 302-318 are not to be repeated, task 320 is performed.

At 320, the integration module 244 integrates (or sums) the amounts of NOx determined for each of the time steps to determine a total amount of NOx out of the ICE 104 TOTNOx (signal 321).

At 322, the actuation module may generate request signals based on an output of the integration module 244 (or the total amount of NOx out of the ICE 104 TOTNOx). The request signals may include an air torque request signal 323, a spark request signal 325, a cylinder-shut-off request signal 327, a fuel torque request signal 329, and an exhaust system request signal 331. These signals may be used to control air flow into the ICE 104, spark timing of the ICE 104, cylinder deactivation of the ICE 104, fuel injection amounts and timing of the ICE 104, and the exhaust system 134.

The air control module 256 may generate, based on the air torque request signal 323, a target manifold absolute pressure (MAP) signal and an air per cylinder (APC) signal. The boost scheduling module 264 and the phaser scheduling module 266 may control the boost actuator module 162 and the throttle actuator module 116 based on the target MAP and APC signals. The spark control module 258 may generate the spark advance signal SA based on the spark torque request signal 325. The cylinder control module 259 may generate the cylinder deactivation signal #Cyls based on the cylinder shut-off request signal 327. The fuel control module 260 generates the fuel rate signal FR based on the fuel torque request signal 329. The exhaust system module 262 generates the exhaust system signal EXH based on the exhaust system request 331. The boost scheduling module 264 generate the boost pressure signal BP based on the target MAP signal. The air control module 256 generates the target area signal TA based on the air torque request. The phaser scheduling module 266 generates the intake angle and exhaust angle signals IA, EA based on the target APC signal. The method may end at 324.

The above-described tasks are meant to be illustrative examples; the tasks may be performed sequentially, synchronously, simultaneously, continuously, during overlapping time periods or in a different order depending upon the application. Also, any of the tasks may not be performed or skipped depending on the implementation and/or sequence of events.

The above-described method includes use of mathematical equations (or functions) that can be derived (or modified) based on engine operating conditions. The method allows for good trend prediction of determined and/or monitored parameters outside corresponding predetermined calibrated ranges.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term 'module' or the term 'controller' may be replaced with the term 'circuit.' The term 'module' refers to or includes: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. §112(f) unless an element is expressly recited using the phrase "means for," or in the case of a method claim using the phrases "operation for" or "step for."

What is claimed is:

1. A system comprising:

a fuel module programmed to, based on a crankshaft angle of an engine, generate a first value indicative of (i) an amount of fuel burned in a cylinder of the engine, or (ii) a change in the amount of fuel burned in the cylinder;

a heat release module programmed to, based on the first value, determine an amount of heat released during a combustion event of the cylinder;

a pressure module programmed to, based on the amount of heat released, estimate a pressure in the cylinder;

a temperature module programmed to, based on the pressure, estimate a temperature in the cylinder;

a concentration module programmed to, based on the pressure or the temperature, estimate nitrogen oxide concentration levels in the cylinder;

an output module programmed to estimate an amount of nitrogen oxides out of the cylinder based on the nitrogen oxide concentration levels, a ratio of (i) a concentration level of nitrogen oxide in the cylinder that is not in an equilibrium state, and (ii) a concentration level of nitrogen oxide in the cylinder that is in an equilibrium state, and a plurality of reaction rates; and a control module programmed to, based on the amount of nitrogen oxides out of the cylinder, control operation of the engine or an exhaust system of the engine.

2. The system of claim 1, wherein:

the fuel module is programmed to determine the amount of fuel burned in the cylinder based on a Wiebe function and an amount of fuel supplied to the cylinder for a combustion cycle of the cylinder and a plurality of precalibrated variables; and the fuel module is programmed to determine the plurality of precalibrated variables based on a type of the engine and an operating condition of the engine.

3. The system of claim 1, wherein:

the first value is the change in the amount of fuel burned in the cylinder relative to a change in the crankshaft angle of the engine; and the first value is greater than 0 and less than or equal to 1.

4. The system of claim 1, wherein the output module is programmed to determine the amount of nitrogen oxides without prior generation of a signal from an in-cylinder pressure sensor or an in-cylinder temperature sensor of the cylinder.

5. The system of claim 1, wherein the heat release module is programmed to determine the amount of heat released based on the change in the amount of fuel burned in the cylinder relative to a change in the crankshaft angle of the engine.

6. The system of claim 1, wherein the heat release module is programmed to determine the amount of heat released based on a product of the amount of fuel burned in the cylinder and a fuel heat value.

7. The system of claim 1, wherein the pressure module is programmed to estimate the pressure based on the amount of heat released, a volume in the cylinder, a specific heat ratio, and the crankshaft angle.

8. The system of claim 1, wherein the temperature module is programmed to estimate the temperature based on the pressure and a volume in the cylinder.

9. The system of claim 1, wherein the concentration module is programmed to estimate the nitrogen oxide concentration levels based on the temperature and a predetermined table relating a plurality of temperatures to a plurality of nitrogen oxide concentration levels.

10. The system of claim 1, further comprising an integration module programmed to sum a plurality of estimated amounts of nitrogen oxides out of the engine, wherein:

the output module is programmed to provide the plurality of estimated amounts of nitrogen oxides for a plurality of time steps; and the control module is programmed to, based on the sum of the plurality of estimated amounts of nitrogen oxides out of the engine, control operation of the engine or the exhaust system of the engine.

11. The system of claim 1, further comprising:

an actuation module programmed to generate a plurality of request signals;

an air control module programmed to control air flow to the engine based on the amount of nitrogen oxides out of the cylinder;

a spark module programmed to control ignition timing of the engine based on the amount of nitrogen oxides out of the cylinder;

a fuel control module programmed to control fuel injection of the engine based on the amount of nitrogen oxides out of the cylinder; and an exhaust system module programmed to control the exhaust system based on the amount of nitrogen oxides out of the cylinder.

12. A method comprising:

based on a crankshaft angle of an engine, generating a first value indicative of (i) an amount of fuel burned in a cylinder of the engine, or (ii) a change in the amount of fuel burned in the cylinder;

based on the first value, determining an amount of heat released during a combustion event of the cylinder;

based on the amount of heat released, estimating a pressure in the cylinder;

based on the pressure, estimating a temperature in the cylinder;

based on the pressure or the temperature, estimating nitrogen oxide concentration levels in the cylinder;

estimating an amount of nitrogen oxides out of the cylinder, based on the nitrogen oxide concentration levels, a ratio of (i) a concentration level of nitrogen oxide in the cylinder that is not in an equilibrium state, and (ii) a concentration level of nitrogen oxide in the cylinder that is in an equilibrium state, and a plurality of reaction rates; and based on the amount of nitrogen oxides out of the cylinder, controlling operation of the engine or an exhaust system of the engine.

13. The method of claim 12, comprising:

determining the amount of fuel burned in the cylinder based on a Wiebe function and an amount of fuel supplied to the cylinder for a combustion cycle of the cylinder and a plurality of precalibrated variables; and determining the plurality of precalibrated variables based on a type of the engine and an operating condition of the engine, wherein the first value is the change in the amount of fuel burned in the cylinder relative to a change in the crankshaft angle of the engine, and wherein the first value is greater than 0 and less than or equal to 1.

14. The method of claim 12, wherein the amount of nitrogen oxides is determined without prior generation of a signal from an in-cylinder pressure sensor or an in-cylinder temperature sensor of the cylinder.

15. The method of claim 12, wherein the amount of heat released is determined based on a product of the amount of fuel burned in the cylinder and a fuel heat value.

16. The method of claim 12, wherein:

the pressure is estimated based on the amount of heat released, a volume in the cylinder, a specific heat ratio, and the crankshaft angle; and the temperature is estimated based on the pressure and a volume in the cylinder.

17. The method of claim 12, wherein the nitrogen oxide concentration levels are estimated based on the temperature and a predetermined table relating a plurality of temperatures to a plurality of nitrogen oxide concentration levels.

18. The method of claim 12, further comprising:

summing a plurality of estimated amounts of nitrogen oxides out of the engine, wherein the plurality of estimated amounts of nitrogen oxides are provided for a plurality of time steps; and based on the sum of the plurality of estimated amounts of nitrogen oxides out of the engine, controlling operation of the engine or the exhaust system of the engine.

* * * * *